United States Patent [19]

Kjaer

[11] 4,273,370

[45] Jun. 16, 1981

[54] DEVICE FOR COLLECTING AND REMOVING DOG DROPPINGS OR THE LIKE

[76] Inventor: Per Kjaer, Nedre Skogvei 4B, Oslo 2, Norway

[21] Appl. No.: 83,549

[22] Filed: Oct. 10, 1979

[30] Foreign Application Priority Data

Oct. 10, 1978 [NO] Norway ..... 783418

[51] Int. Cl.[3] ..... A01K 29/00

[52] U.S. Cl. ..... 294/1 B

[58] Field of Search ..... 294/1 B, 1 BA, 1 BB, 294/16, 25, 99 R; 15/104.8, 257.1, 257.6; 53/390; 141/391; 220/407; 248/95, 97, 99

[56] References Cited

U.S. PATENT DOCUMENTS

| | | | |
|---|---|---|---|
| 3,560,039 | 2/1971 | Gruber | 294/1 B |
| 3,767,247 | 10/1973 | Wetzler | 294/16 |
| 3,861,125 | 10/1975 | Hagemeister | 248/99 X |
| 4,097,082 | 6/1978 | Orofino | 294/1 BA |
| 4,136,900 | 1/1979 | Thompson | 294/1 BB |
| 4,185,861 | 1/1980 | Berner | 294/1 BB |

FOREIGN PATENT DOCUMENTS

| | | | |
|---|---|---|---|
| 1437228 | 3/1966 | France | 248/99 |
| 1449889 | 7/1966 | France | 53/390 |
| 1328814 | 9/1973 | United Kingdom | 248/95 |

*Primary Examiner*—Johnny D. Cherry
*Attorney, Agent, or Firm*—Fleit & Jacobson

[57] ABSTRACT

A device for collecting and removing dog droppings or the like comprises a pair of gripping members which are hingedly connected to each other and arranged to be moved towards each other at free ends of the gripping members at a distance from the hinge connection, and a bag of a flexible material which in operational position is located in the space between the gripping members and at its open end is folded with its mouth portion about the free ends of the gripping members. A construction for holding an object in place is arranged between the gripping members in the vicinity of the hinge connection and is arranged to receive a number of bags, so that the bag may successively be extracted from the construction for holding an object in place for disposition in the operational position.

9 Claims, 3 Drawing Figures

DEVICE FOR COLLECTING AND REMOVING DOG DROPPINGS OR THE LIKE

The present invention relates to a device for collecting and removing dog droppings or the like, comprising a pair of gripping members which are hingedly connected to each other and able to be moved towards each other at free ends of the gripping members remote from the hinge connection, and a bag of flexible material which in operational position is located in the space between the gripping members and at its open end is folded with its mouth portion about the free ends of the gripping members.

Such a device should be cheap in purchase and use, and further it should be easily accessible and simultaneously hygienic and handy to use when one wishes to collect and remove droppings from dogs or the like, so that such droppings will not remain lying on the ground or in other places where people are moving around. Previously known devices for this purpose have not fulfilled these wishes and consequently not satisfied the general presuppositions for achieving the common extension which is desirable from thriving considerations.

A device of the type set forth above is known from U.S. Pat. No. 3,767,247 which discloses a gripping means having a pair of hingedly connected members which are adapted to be placed in a folded-back mouth portion of a specially designed bag-like receptacle. However, the bag-like receptacle as well as the associated gripping means has a complex design, so that the device will be correspondingly expensive to manufacture. With its relatively complicated design this known device is not able to fulfill the above mentioned requirements with respect to cheap operation and simultaneously rational, simple and hygienic application of the device several times in succession.

The object of the present invention is to provide a device for the stated purpose which has a simple design enabling very handy and rational use several times after each other, and which is so small that it can be carried along in a pocket.

The above mentioned objects are achieved by a device of the type set forth above which, according to the invention, is characterized in that it comprises a holding means arranged between the gripping members at a distance from the free ends thereof and arranged to receive a number of bags, so that the bags may successively be extracted from the holding means for disposition in said operational position.

The bag storing possibility obtained with the device according to the invention is very essential, the device thereby allowing convenient and handy application several times after each other, a fresh bag being brought forward simultaneously with the removal of a utilized bag, which fresh bag is ready for use by merely being folded around the free ends of the gripping members.

The invention will be more closely described below in connection with an exemplary embodiment with reference to the accompanying drawings, wherein FIG. 1 shows a perspective view of a device according to the invention;

Figure 1:
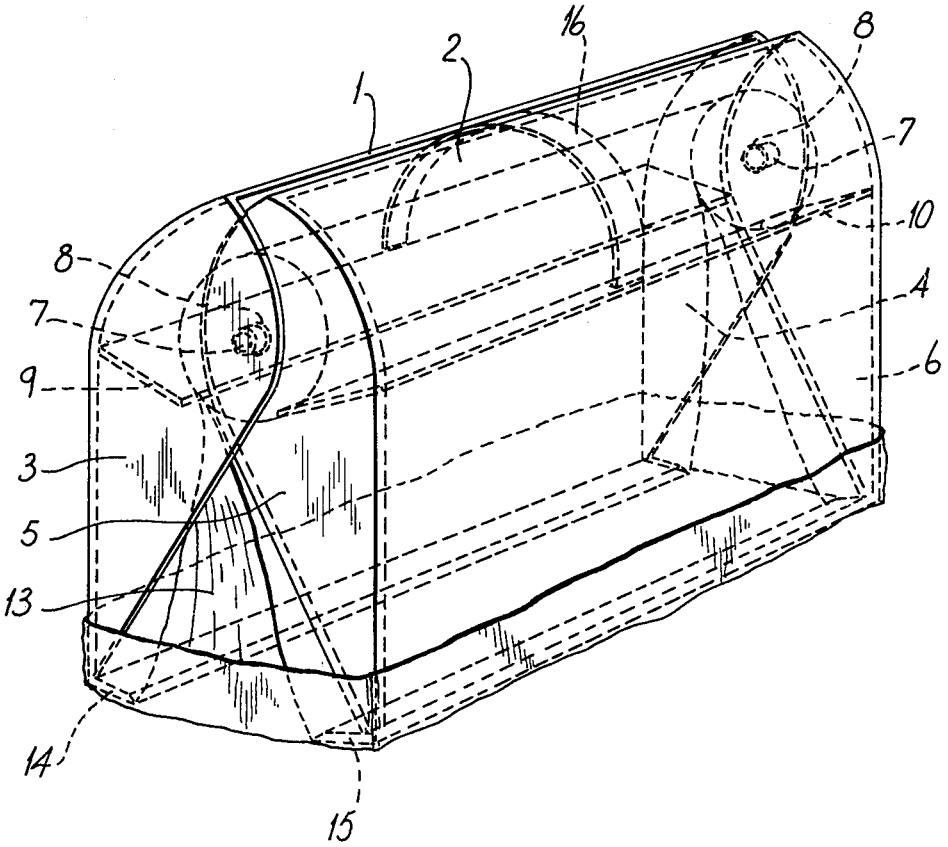
Figure 2:
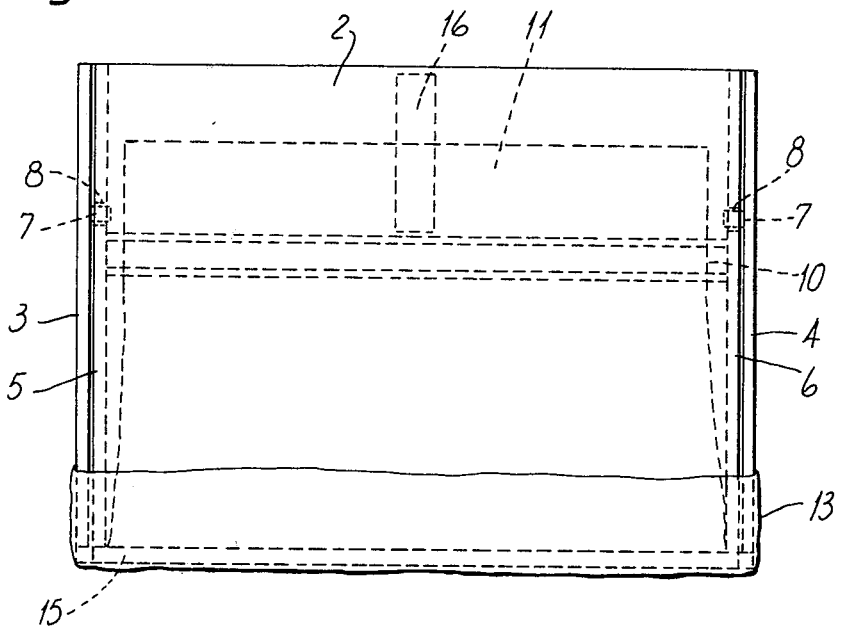
FIG. 2 shows a side view of the device in FIG. 1.
Figure 3:
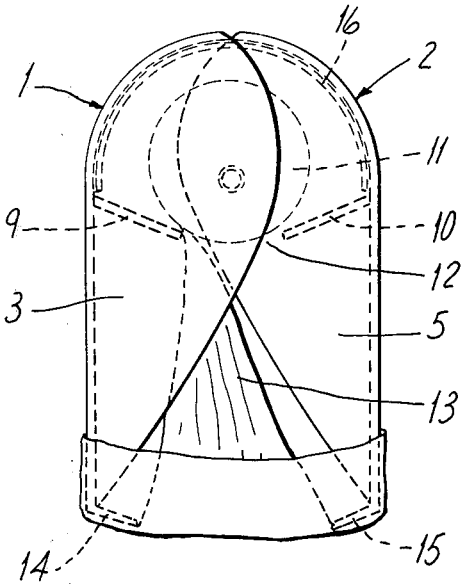
FIG. 3 shows an end view of the device.

As it appears from the drawings, the device in the illustrated embodiment comprises a pair of gripping members 1 and 2 of which each consists of a plate member having a pair of opposite, rising parts in the form of gable portions 3, 4 and 5, 6, respectively, the gable portions 5, 6 of one member 2 being adapted to be introduced between the gable portions 3, 4 on the other member 1. The adjacent gable portions are hinged to each other in that a pin 7 on the outer gable portion 3 and 4, respectively, is introduced in an aperture 8 in the inner gable portion 5 and 6, respectively. Each gripping member may advantageously be manufactured in one piece by casting from a plastics material having suitable rigidity, so that the resilience of the gable portions allows snap introduction of the pins 7 in their apertures 8 by assembly of the gripping members in each other.

In the region of the hinge connection the mutually facing surfaces, i.e. the inner sides, of the gripping members 1 and 2 are provided with respective inwards projecting ribs 9 and 10 which, together with the upper portions of the plate members and the gable portions, as viewed in the drawings, define and form a holding means for the reception of a bag magazine in the form of a roll 11 with a number of bags. Between the parallelly extending ribs 9, 10 there is an opening or gap 12 through which the outermost bag 13 on the roll extends and with its open end is rolled and folded around the lower, free ends of the gripping members 1, 2, so that a bag cavity is formed between the gripping members.

The ribs may be arranged in such a way in relation to each other and to the hinge connection that said gap is closed by suitable compression of the gripping members. The bags are joined to each other along transverse tearing portions and are preferably plastic bags of the type which is formed with side folds, so that each individual bag may easily be extended and folded around the gripping member ends.

As illustrated the free ends of the gripping members are provided with inwards projecting flanges 14 and 15, respectively, extending along the end edges and forming scraper edges and simultaneously holding edges for facilitating collection of the droppings or the like which are to be picked up with the device. In the bag magazine compartment between the gripping members 1, 2 there is placed a blade spring 16 of e.g. steel or plastics which urges the gripping members away from each other at the lower, free ends, so that the gripping members are automatically moved to an outer position when they are not influenced by a compressing force which is larger than the spring force.

The illustrated device may obviously be varied with respect to alternative embodiments. In the illustrated embodiment the two gripping members must be disassembled by insertion of another bag roll. This will be a very simple operation, but if desired, it may be avoided in that e.g. one of the gripping members is provided with a hinged cover above the bag magazine compartment. Further, instead of using a pair of separate, hinged gripping members these may alternatively be formed in one piece of cast plastics material, the members being joined to each other along a flexible, resilient portion forming the hinge connection between the members and simultaneously holding the gripping members away from each other in an outer position when they are not compressed. The gripping members do not necessarily consist of solid material, but may instead consist of a framework, to thereby achieve material saving.

As a hinge connection one might alternatively use a through-going bolt or shaft which simultaneously might receive the roll of bags, the shaft possibly being dismountable by means of suitable holes and associated fastening means in the gable portions of the gripping members.

Further, the device may easily be adapted for operation with an affixed shank or shaft, so that it may be used without the user having to bend down to the ground.

When using the described device this is gripped in that the user places his palm over the upper portion of the device so that the gripping members may be pressed together between the thumb and the other fingers. The device is moved with the free ends of the gripping members downwards over the droppings or the like which are to be picked up, whereafter the gripping members are pressed together so that the droppings will be located in the bag cavity between the gripping members. Thereafter the device is inverted so that the droppings fall completely into the bag. Thereafter the gripping members are released and the bag is pulled completely out, whereafter the gripping members are compressed once again so that the ribs or the free ends of the gripping members keep hold of the next bag, and the used bag may be torn off to be disposed of at a suitable place. The mouth portion of the extracted, unused bag is thereafter folded around the free ends of the gripping members, and the device is ready for another application.

What I claim is:

1. A device for collecting and removing dog droppings or the like, comprising:

a pair of gripping members for facilitating the lifting and gathering of said droppings or the like which members are hingedly connected to each other by a hinge connection and able to be moved towards each other at free ends of the gripping members remote from said hinge connection, a bag of flexible material having an open end with a mouth portion, said bag in its operational position being located in the space between said gripping members and with its open end folded with its mouth portion about said free ends of the gripping members, and a holding means arranged between said gripping members at a distance from the free ends thereof and arranged to receive a number of said bags, so that the bags may successively be extracted from said holding means for disposition in said operational position.

2. A device for collecting and removing dog droppings or the like, comprising:

a pair of gripping members which are hingedly connected to each other by a hinge connection and able to be moved towards each other at free ends of the gripping members remote from said hinge connection, a bag of flexible material having an open end with a mouth portion, said bag in its operational position being located in the space between said gripping members and with its open end folded with its mouth portion about said free ends of the gripping members, and a holding means arranged between said gripping members at a distance from the free ends thereof and arranged to receive a number of said bags, so that the bags may successively be extracted from said holding means for disposition in said operational position, wherein mutually facing surfaces of the gripping members in the region of said hinge connection are provided with respective inwards projecting ribs which, together with said gripping members form said holding means for the bags, a gap for bag passage being provided between said ribs.

3. A device according to claim 2, wherein said holding means is arranged to receive a roll of plastic bags having side folds extending along the side edges thereof and being joined to each other along transverse tearing portions.

4. A device according to claim 2 or 3, wherein said ribs are arranged to close said gap when pressing together the gripping members, to thereby keep hold of the bag located between said ribs.

5. A device according to claim 1, wherein said holding means is arranged to receive a roll of plastic bags having side folds extending along the side edges thereof and being joined to each other along transverse tearing portions.

6. A device for collecting and removing dog droppings or the like, comprising:

a pair of gripping members which are hingedly connected to each other by a hinge connection, said hinge connection extending the entire length of one edge of each gripping member and said pair of gripping members able to be moved towards each other at free ends of the gripping members remote from said hinge connection;

a bag of flexible material having an open end with a mouth portion, said bag in its operational position being located in the space between said gripping members and with its open end folded with its mouth portion about said free ends of the gripping members; and a holding means arranged between said gripping members at a distance from the free ends thereof and arranged to receive a number of said bags, so that the bags may successively be extracted from said holding means for disposition in said operational position.

7. A device according to claim 6, wherein a closed container is defined by said gripping members when the free ends of each of said gripping members meet.

8. A device according to claim 1, wherein the hinge connection of the gripping members is located along only one axis.

9. A device according to claim 1, wherein said pair of gripping members pivot about a common axis, and said holding means is structured to receive a roll of bags, which roll is rotatable when located within said holding means.

* * * * *